United States Patent [19]

Anderson

[11] Patent Number: 4,662,422

[45] Date of Patent: May 5, 1987

[54] SUPPORT FOR AN OPERATING ELEMENT OF A VERTICAL BLIND ASSEMBLY

[75] Inventor: Richard N. Anderson, Owensboro, Ky.

[73] Assignee: Hunter Douglas, Inc., Upper Saddle River, N.J.

[21] Appl. No.: 725,456

[22] Filed: Apr. 22, 1985

[51] Int. Cl.[4] ..... A47H 5/03; A47H 5/032; E06B 9/36

[52] U.S. Cl. ..... 160/168 R; 160/178 R; 160/126

[58] Field of Search ..... 160/126, 345, 168 R, 160/166 A, 166, 178 R; 16/93 R, 93 D

[56] References Cited

U.S. PATENT DOCUMENTS 3,280,891 10/1966 Eldredge et al. ..... 160/178 R

*Primary Examiner*—Ramon S. Britts
*Assistant Examiner*—Cherney S. Lieberman
*Attorney, Agent, or Firm*—Pennie & Edmonds

[57] ABSTRACT

A support for an operating element of a vertical blind assembly when the blind assembly is in an open position. The support is positioned in a stationary manner with respect to a headrail and is adapted to be moved into and out of supportive engagement with the operating element. The supporting means comprises an L-shaped arm having a short leg and a long leg adapted to be contacted by a movable member and where contact with the member will cause the arm to pivot so that the long arm will move into and out of engagement with the operating element.

10 Claims, 8 Drawing Figures

SUPPORT FOR AN OPERATING ELEMENT OF A VERTICAL BLIND ASSEMBLY

FIELD OF THE INVENTION

This invention relates to a support for an operating element of a vertical blind assembly and more particularly to a support which is mounted or fixed in a stationary position with respect to a headrail and which is movable into and out of supporting engagement with the operating element as the blind assembly is moved to and from open and closed positions.

BACKGROUND OF THE INVENTION

Vertical blind assemblies, for example vertical venetian blinds which extend over a wide window or door opening, often have operating elements, i.e. a rotatable shaft or operating cords, which extend over the width of the opening to which the blind assembly is applied and which are used to provide means for opening or closing the blind assembly and/or to tilt the slats of the assembly. Where the width of the opening is large, the operating element or elements may tend to sag if no means are provided for supporting the same. This may in turn lend to an unsightly appearance and even to difficulty in operating the blind assembly.

In conventional vertical venetian blind assemblies, individual slats are supported by slat support means in the form of travelers where the travelers are movable along and are supported by a headrail. The travelers also may support the operating element. Thus when the blind assembly is closed, that is when the vertical slats of the venetian blind assembly extend across the width of the opening, the travelers themselves may provide means for supporting the operating element along portions of its length. However, when the blind assembly is moved to an open position, that is when the slats are moved to one side of the opening, the travelers carrying the slats are also moved to one side of the opening thus removing support for the operating element. Where the operating element comprises a rotatable shaft, the shaft may tend to sag and in those instances where the element comprises one or more operating cords, the cords may sag.

Conventional vertical blind assemblies have overcome this sagging problem by providing for one or more support means for an operating element in the form of carriages which are moved along the length of the headrail as the blind is moved towards an open position to substitute for the support provided by the travelers as the travelers are moved towards the open position. The force necessary to move these carriages, when combined with that necessary to move the travelers, may in many instances become excessive and the hardware required for moving the carriages as well as the carriages themselves is relatively expensive and complicated to install, is not easily adjustable and often is not reliable in operation.

The same problems that exist with vertical venetian blind assemblies also may exist with draperies that are used to open and close window or door openings. In some instances the portions of the fabric comprising the drapery are carried by travelers which are moved along a headrail by an operating element. This element may be subjected to the same bending and sagging problems that exist with vertical slatted venetian blind assemblies.

It is therefore an object of my invention to provide for a support for a vertical blind assembly which is movable into supporting engagement with an operating element to support the element along portions of its length when the blind assembly is in an open position and which is movable out of supportive engagement with the operating element when the blind assembly is moved to a closed position.

It is a further object of the invention to provide for a support for an operating element of a vertical blind assembly which may be mounted in a stationary position with respect to a headrail which is relatively inexpensive to manufacture, which is easy to install in a headrail and which is reliable in operation.

GENERAL DESCRIPTION OF THE INVENTION

Broadly a support for an operating element of a vertical blind assembly constructed according to my invention is adapted for use in a blind assembly having a headrail which extends at an angle to the vertical and includes a plurality of travelers which are movable longitudinally on the headrail. Each traveler is adapted to carry a vertically extending portion of the blind assembly. An operating element extends parallel to the headrail and is supported at intervals along its length in a blind closed position by the travelers and operating element support means are provided for supporting the operating element in a blind open position. Means are provided for moving the travelers towards blind open and closed positions. Each support means is adapted to be mounted in a stationary position with respect to the headrail at any point along the length thereof. Each operating element support means includes a support element adapted to be moved into supporting engagement with the operating element in response to a contact member moving towards said blind open position and to move the support element out of supporting engagment with the operating element in response to the contact member moving towards the blind closed position.

The support element preferably comprises an arm adapted to move into and out of supporting engagement with the operating element in response to movement of the lead traveler of the plurality of travelers. Preferably the arm is L-shaped and includes a short leg and a long leg with the arm pivotal about an axis extending perpendicular to the juncture of the legs to pivot in a plane whereby the long leg may be moved into and out of supporting engagement with the operating element and whereby the free end of the long leg may engage a further portion of the headrail.

The support element further is positioned so that the pivot axis is perpendicular to the longitudinal axis of the headrail such that the long leg is adapted to be engaged by the contact member, which is mounted on the lead traveler, when the lead traveler moves towards a blind closed position to pivot the arm and long leg out of supporting engagement with the operating element and such that the short leg is adapted to be engaged by the contact member when the lead traveler moves towards a blind open position to pivot the arm and long leg into supporting engagement with the operating element.

Preferably the operating element support means includes a base portion which pivotally mounts the arm and the base portion includes mounting means for mounting the support to the headrail.

The operating element support means further includes a resiliant latch means to retain the support element in a supportive engagement with the operating element when it is not contacted by the lead traveler.

The operating element may comprise an operating shaft or it may comprise other forms of an operating element, as for example, one or more operating cords.

The blind assembly may comprise a plurality of vertical slats where each traveler supports a slat or may comprise a vertially extending drape where each traveler supports a portion of the drape.

While the blind assembly with which the support means is adapted for use normally includes a horizontally extending headrail, the headrail could be inclined at an angle with respect to the horizontal.

DESCRIPTION OF THE PREFERRED EMBODIMENT

Figure 1:
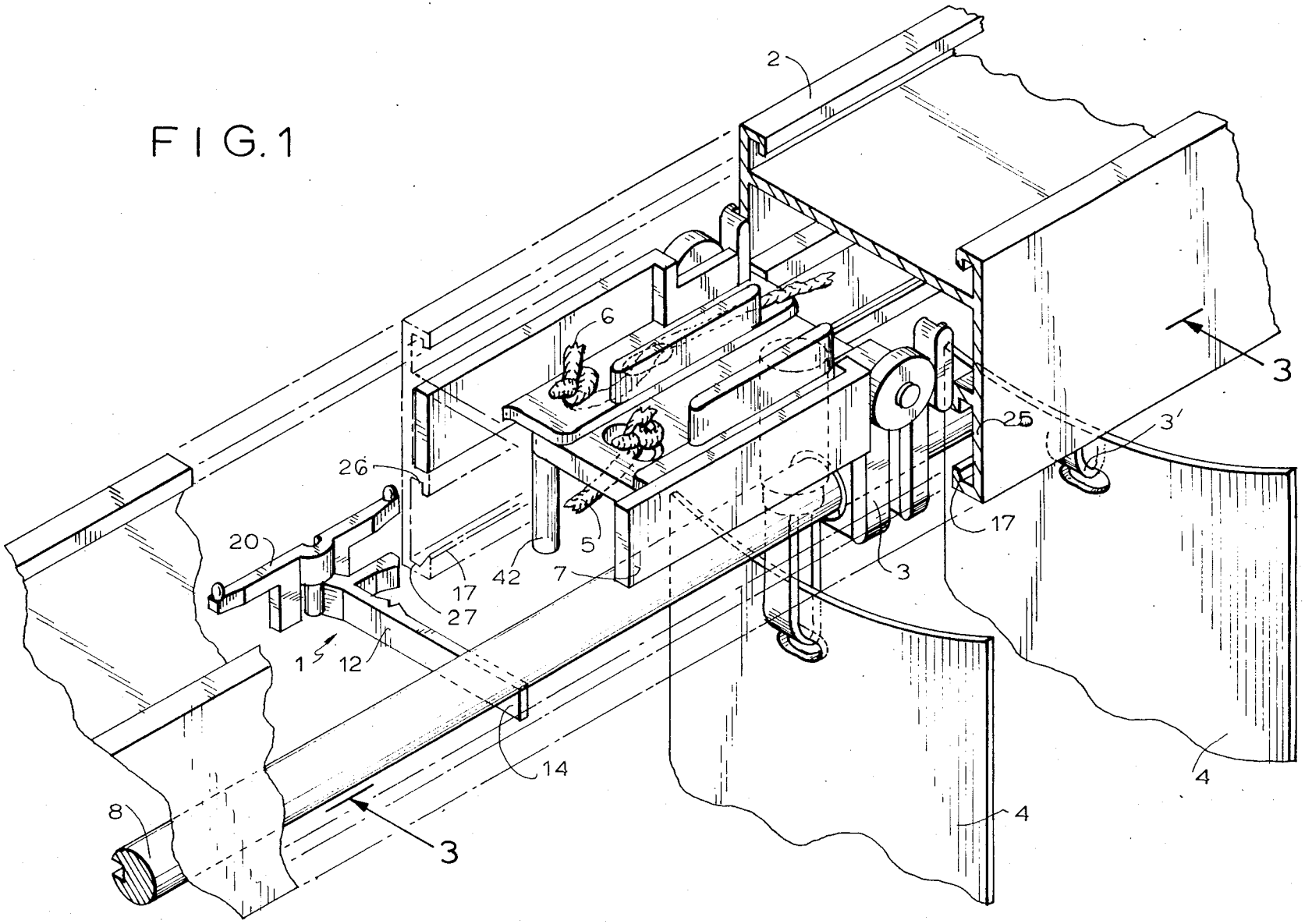
FIG. 1 is a broken perspective view of a vertical blind assembly constructed according to the invention.
Figure 2:
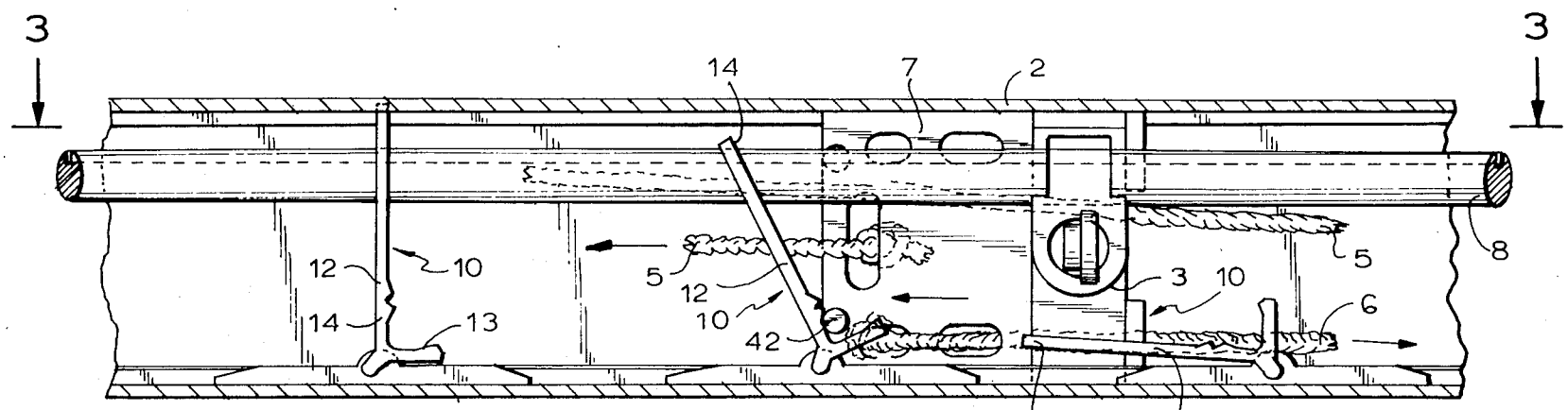
FIG. 2 is a bottom view of the blind assembly of FIG. 1.
Figure 3:
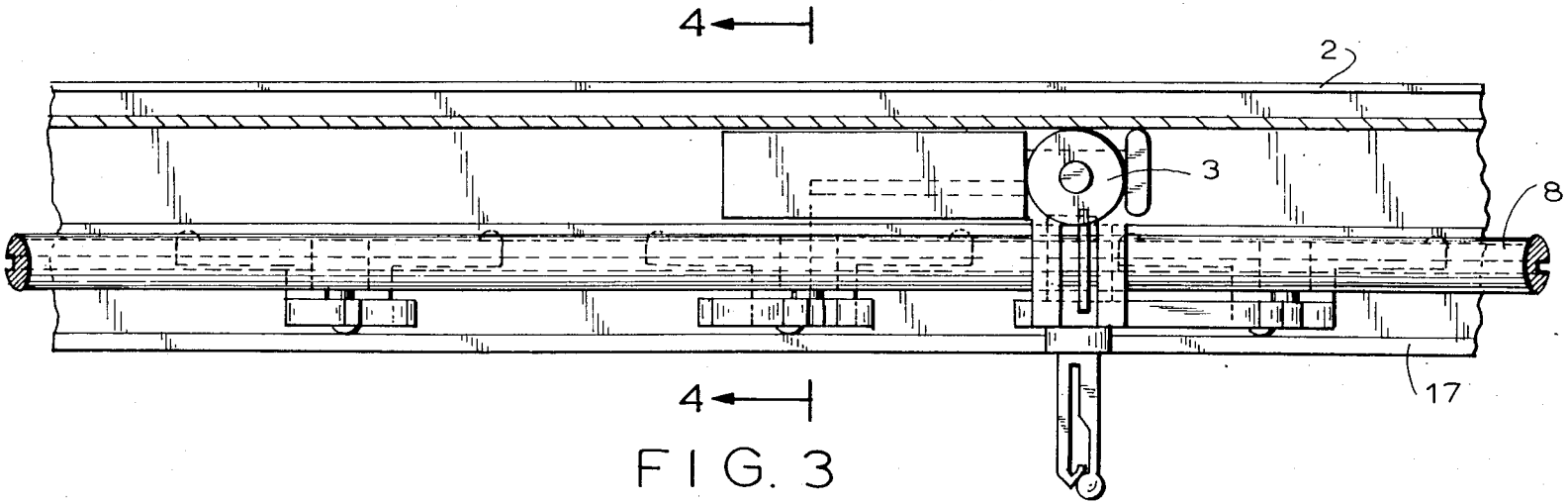
FIG. 3 is a broken front view of the blind assembly of FIG. 1 taken in the direction of the arrows 3—3 in FIG. 1.

Referring to the drawings and particularly to FIGS. 1–3 there is disclosed a support 1 for supporting a vertical venetian blind assembly where the assembly includes a longitudinally extending headrail 2 having a plurality of travelers therein including a lead traveler 3 and a pluraltity of trailing travelers 3', only a portion of one of which is shown in FIG. 1, each individully supporting a vertically extending slat 4. The lead traveler 3 is adapted to be moved longitudinally with respect to the headrail 2 by means of a blind closing cord 5 and a blind opening cord 6 which connect with a movable element in the form of a lead traveler bridle 7 in turn fixed to the lead traveler.

A operating element in the form of an operating shaft 8 is positioned within the headrail longitudinally thereof and extends through each of the travelers including the lead traveler to be partially supported thereby.

A plurality of shaft support means 10 are spaced longitudinally in a stationary manner on the headrail 2 as shown in FIG. 2 and support the operating shaft 8 at intervals along its length when the travelers are moved to a blind open position and where the travelers themselves would be grouped at one end of the headrail and be incapable of supporting the operating shaft at a middle or opposite end portion of the headrail.

Figure 7:
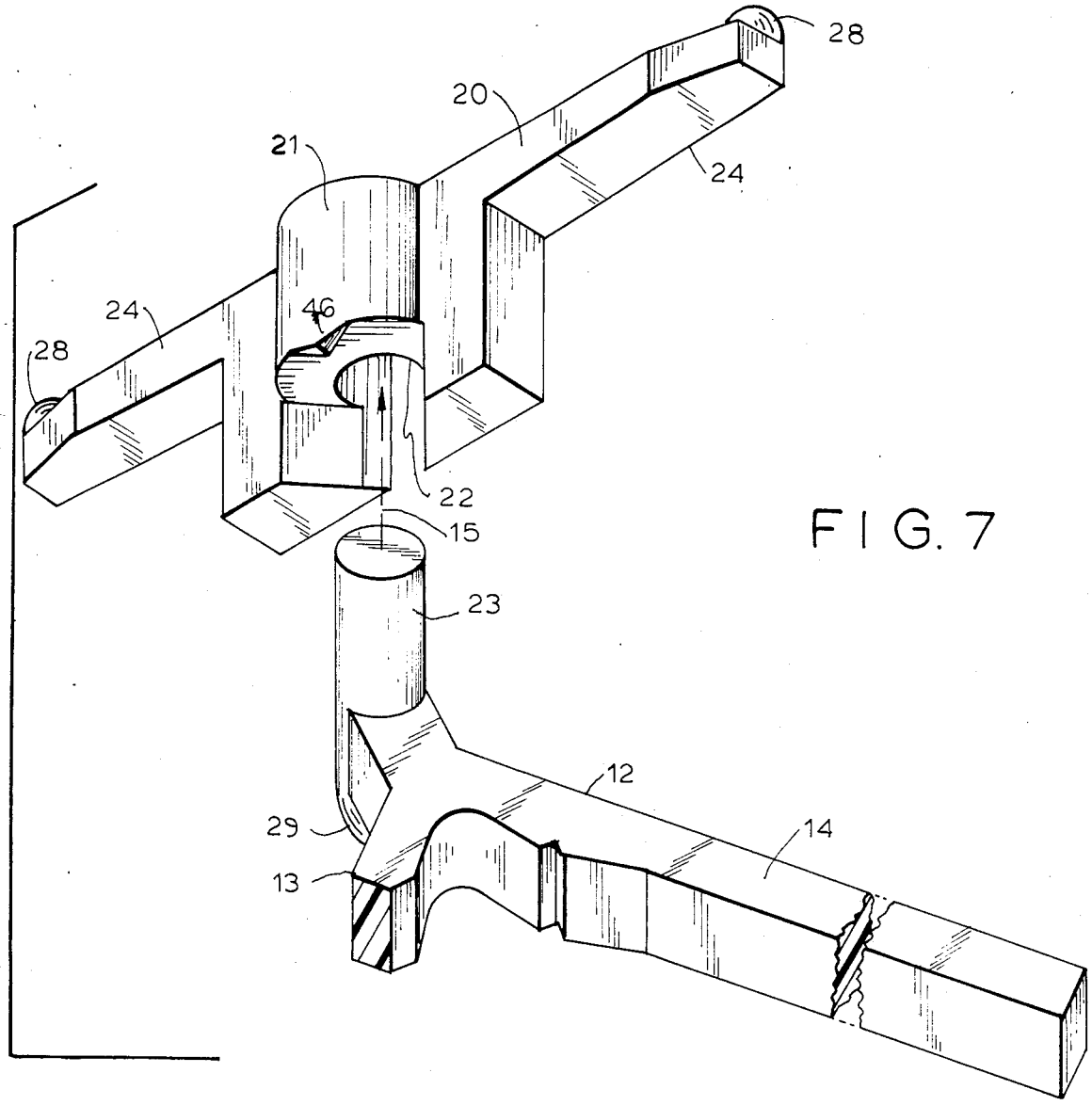
FIG. 7 is a perspective enlarged broken view of a support element of the support means illustrated in FIG. 1.

Each shaft support means comprises an arm 12 which, as shown in FIGS. 1 and 2, is adapted to pivot into and out of supporting engagement with the shaft 8. Each arm is substantially L-shaped and includes a short leg 13 and a long leg 14. The arm itself is pivotal about a pivot axis 15, as shown in FIG. 7, extending perpendicular to the juncture of the legs 13 and 14. As is apparent from FIG. 1, it is the long leg 14 of the leg 12 that swings into and out of supporting engagement with the bottom of the shaft 8.

The long leg 14 is of such a length that its free end will engage with a shoulder or rim 17 on the bottom edge of the headrail when the arm is fully pivoted into supporting engagement with the shaft. In this manner the long leg is supported at both ends thus reducing any tendency of the leg to bend under supporting loads exerted by the shaft.

Each support means includes a base portion 20 as shown in FIG. 7 and a semi-tubular portion 21 including a partial bore 22 therein into which a stub extension 23 of the arm 12 may fit so that the base portion may rotatably support the arm 12 to pivot about the pivot axis 15. Each base portion 20 further includes resilient legs 24 which are adapted to be fitted within a track 25 of the headrail, as shown in FIG. 1, and where the track 25 includes engaging shoulders 26 and 27. As shown nibs 28 on one side of the legs 24 engage shoulder 26 while a nib 29 on one end of the stub extension 23 engages shoulder 27 of the track 25. The flexible or resilient legs 24 thus allow the base and arm to be snap-fitted into the track 25 and the resiliency of the legs is sufficient to lock the base portion and arm into a stationary position longitudinally on the headrail at any desired position along the length of the headrail. It is obvious that other means could be utilized to fixedly position the base portion 20 on the headrail, i.e. by screws to fasten the base portion to the headrail.

Figure 4:
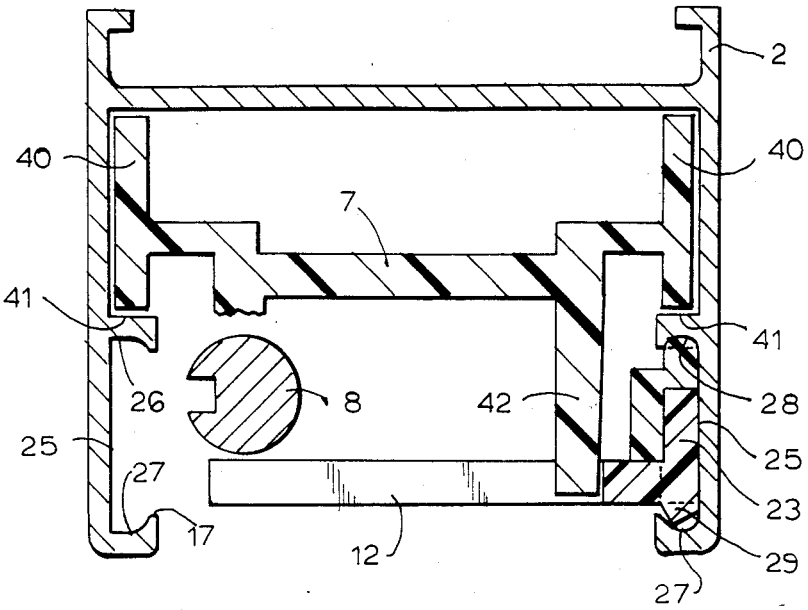
FIG. 4 is an enlarged cross-sectional view of FIG. 3 taken along lines 4—4.
Figure 5:
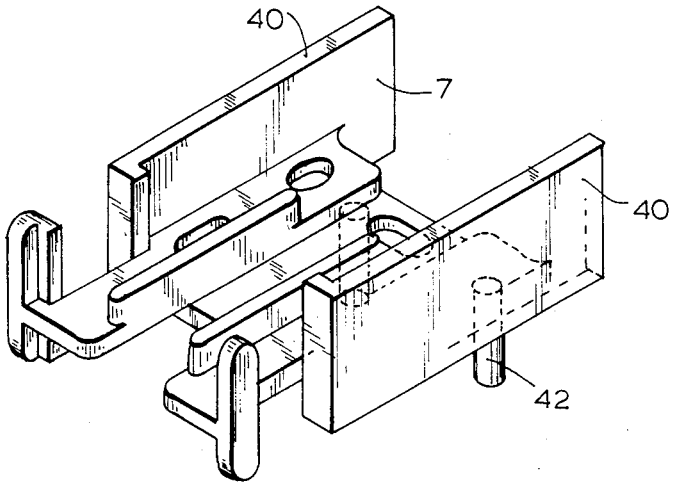
FIG. 5 is a perspective view of a lead traveler bridle forming a part of the blind assembly illustrated in FIG. 1.
Figure 6:
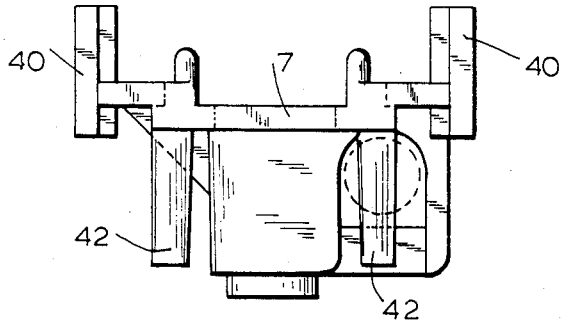
FIG. 6 is a view of the leading end of the lead traveler bridle of FIG. 5 before installation in a blind assembly.

Referring to FIGS. 4–6 the lead traveler bridle 7 includes flanges 40 which engage on a rail 41 contained in the headrail 2 in order that the bridle may slide along the length of the headrail. The bridle includes a contact member 42 thereon, which as explained hereafter, is adapted to engage an arm 12 of a shaft support means to move the arm into and out of supporting engagement with the shaft 8. As shown in FIG. 6, the bridle 7 is initially provided with two contact members 42 wherein one of the members is adapted to be snapped off prior to assembly within a headrail and depending upon whether the bridle moves from one end of the headrail or the opposite end of the headrail towards a blind closed position.

Referring to FIGS. 1 and 2 it is seen that when the bridle 7 is pulled to the left by cord 5 toward the blind closed position, that the contact member 42 will contact the long leg 14 of the arm to cause it to pivot and move the leg 14 out of supportive engagement with the shaft 8. Support for the shaft is then provided by the lead traveler 3 and subsequent following travelers. When the bridle 7 is moved to the right as shown in FIG. 2 by the cord 6 to the blind open position, the contact member 42 will contact the short leg 13 of the arm 12 to cause the arm to pivot in a clockwise direction such that the long leg 14 will again engage and support the bottom of the shaft 8. It is seen by reference to FIG. 2 that the movement of the several arms caused by contact with the contact member 42 is sequential and depends upon the direction of travel of the bridle and the lead traveler to which it is attached.

In the event that the blind assembly were to be positioned on an opposite end of the headrail from that shown in FIG. 1 such that movement of the bridle to the right as shown in FIG. 1 were to be towards a blind closed position, then the support means 10 would be positioned on the opposite side of the headrail from that shown in FIG. 1. In this instance the long leg and short leg of the arm 12 would have to be interchanged from that shown in FIG. 1.

Figure 8:
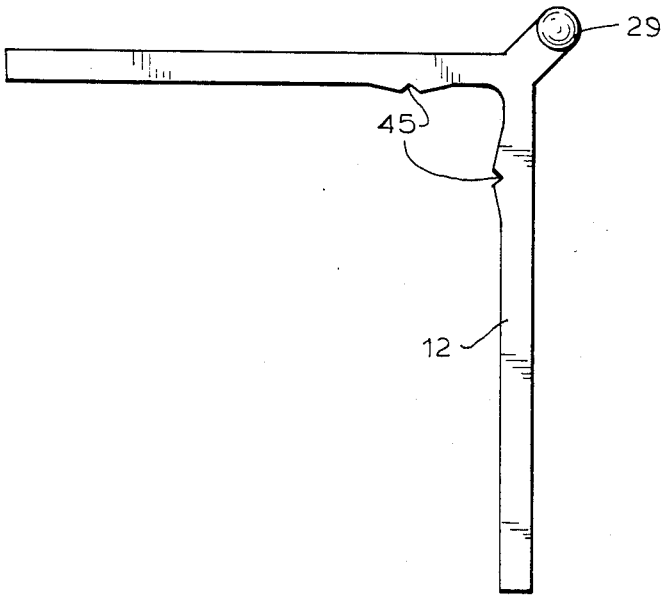
FIG. 8 is a plan view of the support element shown in FIG. 7.

Referring to FIG. 8 there is shown an arm construction before installation with a base member in which both legs of the arm are of a length equal to a long arm 14. Both legs are constructed with a notch 45 in order that an end portion from either leg may be easily broken off to make a short leg. By this construction the arm 12 may be easily adapted for insertion into the base member 20 not withstanding whether the base member is to be positioned on either a front or back side of a headrail 2 with the result that inventory of separate parts may be kept at a minimum.

Referring to FIG. 7 it is seen that the base portion 20 is provided with a double incline section 46 which acts as a resilient latch to retain the arm 12 in either an open or closed position after it has been moved thereto by contact with the contact member 42. This latch member prevents any bounce-back of the arm which might result from either the short or long legs contacting the side of the headrail upon any violent or fast movement of the bridle.

While the supporting means has been described as being used with a blind assembly having a plurality of vertical slats, the same construction would be adaptable for use with a blind assembly comprising a drape. In this instance the travelers would support or hold portions of the drape with the drape hanging vertically from the travelers.

Further while the supporting means have been described as engaging an operating shaft, they could also engage other operating elements, as for example, operating cords. Even in the structure shown, the support means 10 are available to support the cord 5 if for any reason it becomes slackened and if the arms 12 were pivoted to the shaft engaging position.

It is seen that a supporting means as described comprises a minimum of easily assembled parts inexpensive to manufacture. It is seen further that movement of the bridle will result in positive actuation of the supporting means to assure dependable operation with a minimum of operating force.

I claim:

1. A support for the operating shaft of a vertical blind assembly having a plurality of vertically extending slats where said blind assembly includes a longitudinal headrail extending at an angle with respect to the vertical direction, a plurality of slat carrying travelers including a lead traveler, a contact member movable with the lead traveler and movable longitudinally with respect to the headrail towards blind open and blind closed positions, an operating shaft extending parallel to said headrail and supported at intervals along its length when in a blind closed position by said travelers, shaft support means for supporting said shaft in a blind open position, and means for moving said travelers and said contact member towards said blind open and said blind closed position; said shaft support means being adapted to be mounted in a stationary position with respect to said headrail at any point along the length thereof and having a support element adapted to move into supporting engagment with said operating shaft in response to said contact member moving towards said blind open position and to move out of supporting engagement with said shaft in response to said contact member moving towards said blind closed position.

2. A support according to claim 1 wherein said shaft support element is mounted at any one of a plurality of preselected positions along the length of the headrail.

3. A support according to claim 1 wherein said support element comprises an arm adapted to pivot into and out of supporting engagement with said shaft in response to said lead traveler moving along said headrail.

4. A support according to claim 3 wherein said arm is substantially L-shaped including a short leg and a long leg and wherein said arm is pivotal about a pivot axis extending perpendicular to the juncture of said legs to pivot in a plane whereby said long leg may be moved into and out of supporting engagement with said shaft.

5. A support according to claim 4 wherein said axis is perpendicular to the longitudinal axis of said headrail, wherein said contact member is mounted on a traveler bridle connected to said lead traveler and wherein said long leg is adapted to be engaged by said contact member when said contact member moves towards a blind closed position to pivot said arm and long leg out of supporting engagement with said shaft and wherein said short leg is adapted to be engaged by said contact member when said contact member moves towards a blind open position to pivot said arm and long leg into supporting engagement with said shaft.

6. A support according to claim 3 where said shaft support means in addition includes a base portion for pivotally mounting said arm, and mounting means on said base portion for mounting said base portion to said headrail.

7. A support according to claim 1 wherein said shaft support means is adapted to be supported by further portions of the headrail while in supporting position with respect to said operating shaft.

8. A support according to claim 1 having in addition resilient latch means to retain said shaft support means in a shaft supporting position when not contacted by said contact member.

9. A support for the operating means of a laterally movable drape adapted to be moved to open and closed positions, where said drape includes a plurality of vertically disposed drape portions each depending from a traveler supported by and movable along a longitudinal headrail extending at an angle with respect to the vertical direction, said operating means extending parallel to said headrail and in a closed position of the drape being supported at intervals along the length of said headrail by said travelers, a movable element, and a pull cord for moving said travelers towards open and closed positions of said drape; said support being mounted in a stationary manner in at least a number of locations along the length of said headrail, said support having a support element adapted to move into a supporting position with respect to said operating means in response to said movable element moving said drape towards the open position and adapted to move out of said supporting position in response to said movable element moving said drape towards the closed position.

10. In a vertical blind assembly comprising a plurality of vertically disposed slats each depending from a traveler with each traveler being movably supported by and guided along a longitudinal headrail extending thereabove at an angle with respect to the vertical direction, operating means extending parallel to said headrail, said operating means comprising a movable element and pull cord associated with a leading one of said travelers for moving said travelers towards open and closed positions of said blind and a plurality of supports adapted to support said operating means at intervals along the length of said headrail in an open position of said blind; the improvement wherein said supports are mounted in a stationary position along the length of said headrail and each support includes an arm adapted to pivot sequentially into and out of a supporting position with respect to said operating means in response to movement of said movable element along said headrail, whereby each support is actuated directly upon contact by said lead traveler.

* * * * *